United States Patent [19]

Saruwatari et al.

[11] Patent Number: 4,591,261

[45] Date of Patent: May 27, 1986

[54] IMAGE FORMING APPARATUS WITH VARIABLE ROTATIONAL SPEED OF DEVELOPERS

[75] Inventors: Ryoji Saruwatari; Yoshiharu Taniyama, both of Yokohama, Japan

[73] Assignee: Kabushiki Kaisha Toshiba, Kawasaki, Japan

[21] Appl. No.: 727,000

[22] Filed: Apr. 25, 1985

[30] Foreign Application Priority Data

Apr. 27, 1984 [JP] Japan ..... 59-85621

[51] Int. Cl.[4] ..... G03G 15/01; G03G 15/08

[52] U.S. Cl. ..... 355/4; 355/3 DD; 355/14 D; 118/657; 430/122

[58] Field of Search ..... 355/4, 3 DD, 14 D; 118/657, 651; 430/122

[56] References Cited

U.S. PATENT DOCUMENTS

| | | | |
|---|---|---|---|
| 3,405,682 | 10/1968 | King et al. | 118/637 |
| 3,970,042 | 7/1976 | Rees | 118/637 |
| 4,111,151 | 9/1978 | Ruckdeschel | 355/4 X |
| 4,146,325 | 3/1979 | Lange | 355/14 D |
| 4,189,224 | 2/1980 | Sakai | 355/4 |
| 4,232,961 | 11/1980 | Masuda | 355/14 |
| 4,264,185 | 4/1981 | Ohta | 355/4 |
| 4,308,821 | 1/1982 | Matsumoto et al. | 355/4 X |
| 4,469,433 | 9/1984 | Kurata | 355/4 |

FOREIGN PATENT DOCUMENTS 1365753 9/1974 United Kingdom .

*Primary Examiner*—A. C. Prescott

*Attorney, Agent, or Firm*—Schwartz, Jeffery, Schwaab, Mack, Blumenthal & Evans

[57] ABSTRACT

An image forming apparatus comprises a rotatable, drum-shaped photosensitive member carrying thereon a latent image responsive to an original image, a first developing roller adapted to supply a first developing agent to the photosensitive member while rotating, thereby developing the latent image, second developing roller adapted to supply the second developing agent to the photosensitive member while rotating, thereby developing the latent image and a first and second motor assembly for rotating the photosensitive member and selectively rotating the first and second developing rollers to move the photosensitive member relatively to the first developing roller at a first relative speed when the first developing roller is rotated and to move the photosensitive member relatively to the second developing roller at a second relative speed different from the first relative speed when the second developing roller is rotated.

14 Claims, 7 Drawing Figures

IMAGE FORMING APPARATUS WITH VARIABLE ROTATIONAL SPEED OF DEVELOPERS

BACKGROUND OF THE INVENTION

The present invention relates to an image forming apparatus capable of developing operation using, for example, two developing agents, and more specifically to an image forming apparatus in which two types of two-component developing agents are selectively used for selective developing operations with different effects.

Development of color versions of image forming apparatuses, such as copying machines, have recently been in progress. For example, two-color copying machines have been developed for practical use in which color images are developed by superposing a developing agent of a color other than black on a black developing agent.

In one such conventional two-color copying machine, a copy image representing black regions of an original image is first developed by a black developing agent and formed on a copy paper sheet. After copying, the sheet is temporarily removed from the machine. Then, an operator feeds the removed sheet again into the machine. In the machine, the sheet, with the black toner image previously formed thereon, undergoes another cycle of copying operation, in which a copy image representing red regions of the original image is developed by a red developing agent and formed on the sheet. The sheet, carrying thereon the complex image formed on the two developing agents of different colors, is finally discharged from the machine. Thus, the copying operation as an entire sequence is completed.

In the prior art two-color copying machines of this type, two developing units are required as developing means for two-color developing. High-speed copying operation should, however, require the use of magnet rolls with greater diameters in the developing units. Accordingly, it would be difficult to furnish the copying machines with two developing units each.

SUMMARY OF THE INVENTION

The present invention is contrived in consideration of these circumstances, and is intended to provide an image forming apparatus which is small-sized, light in weight, and simple in construction, and which is adapted for use in high-speed copying operation including two steps of developing.

In order to achieve the above object of the present invention, there is provided an image forming apparatus which comprises a plurality of developing means each including a rotating member carrying a developing agent thereon, and in which a latent image on an image carrier is developed by selectively driving these developing means. In this image forming apparatus, the rotating member of one of the developing means is different in a moving speed from that of another, and the moving speed of the image carrier varies depending on the developing means selected for drive.

BRIEF DESCRIPTION OF THE DRAWINGS

FIGS. 1 to 6 show one embodiment of an image forming apparatus according to the present invention applied to a copying machine, in which FIG. 1 is a front view showing the internal construction of the copying machine, FIG. 2 is a front view showing a state in which a first developing unit is on, FIG. 3 is front view showing a state in which a second developing unit is on, FIG. 4 is an extractive front view schematically showing first and second driving force transmission systems, FIG. 5 is a developed sectional view showing the driving force transmission systems of FIG. 4, and FIG. 6 is a sectional view illustrating how a driving force is transmitted to a driving gear.

DETAILED DESCRIPTION OF THE PREFERRED EMBODIMENTS

One embodiment of an image forming apparatus according to the present invention applied to a two-color copying machine will now be described in detail with reference to the accompanying drawings.

Figure 1:
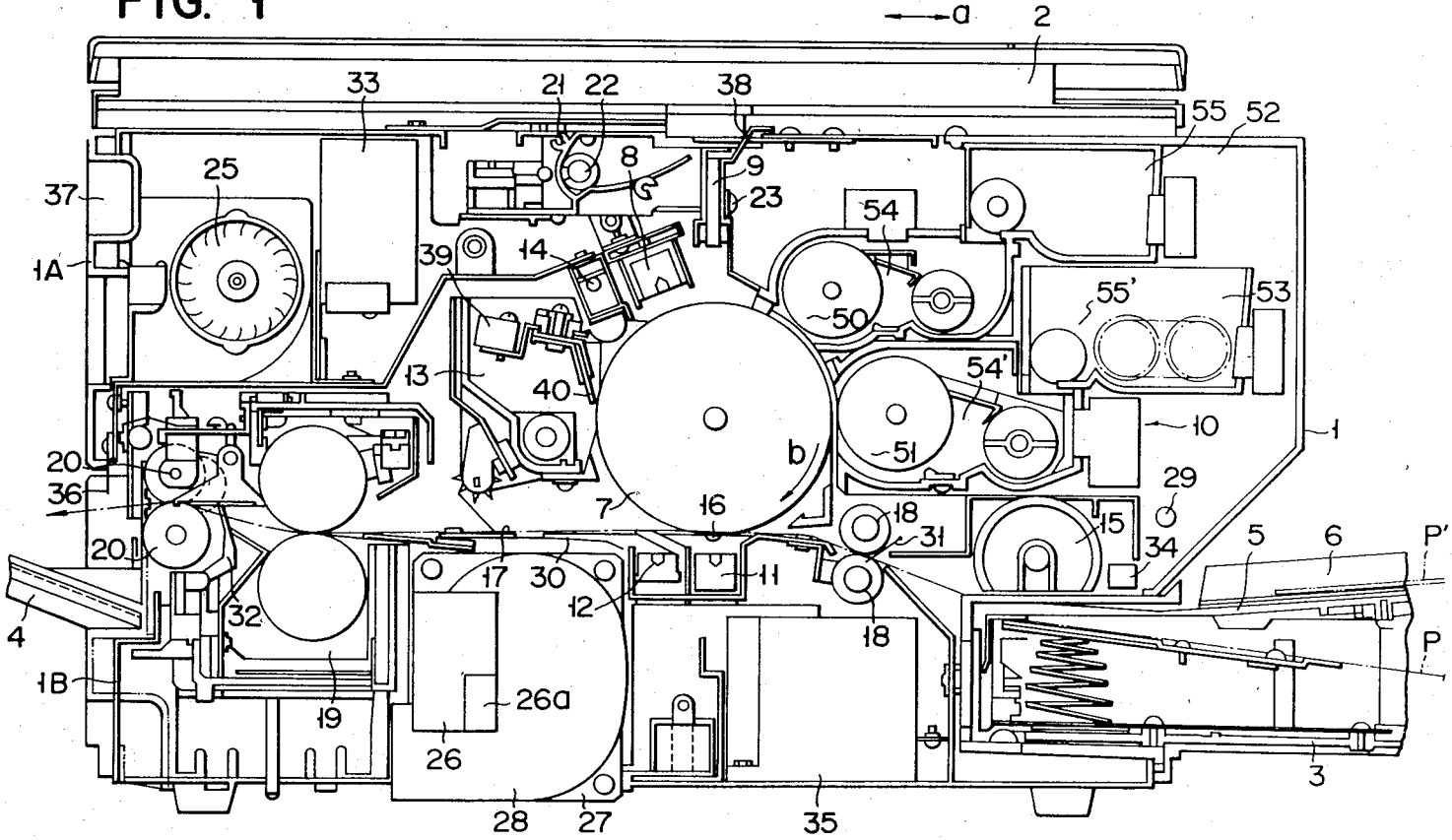

FIG. 1 shows the construction of the two-color copying machine incorporating a developing device which constitutes a feature of the present invention. In FIG. 1, numeral 1 designates a copying machine housing. The housing 1 carries thereon an original table 2 which can reciprocate in the horizontal direction (indicated by arrow a) of FIG. 1. A control panel (not shown), which carries a display, ten-key unit, color designating buttons, exposure setting dial, print key, etc., is provided on the front edge portion of the top surface of the housing 1.

A paper cassette 3 and a receiving tray 4 are removably attached to the right- and left-hand side portions, respectively, of the copying machine housing 1. A cassette cover 5 is mounted on the top of the paper cassette 3. The cassette cover 5 serves as a sheet-bypass guide 6 for manually supplied paper sheets P'.

A drum-shaped photosensitive member 7 as an image carrier is disposed substantially in the center of the copying machine housing 1 so as to be rotatable in the clockwise direction as indicated by arrow b in FIG. 1. Photosensitive member 7 is surrounded by a main charger 8, an exposure unit 9, a two-color developing device 10 (described in detail later), a transfer unit 11, a separation unit 12, a cleaning unit 13, and an after-image erasing unit 14 which are arranged successively in the direction of arrow b.

A paper conveying path 17 is formed in the copying machine housing 1 at the lower portion thereof. The paper conveying path guides a paper sheet P automatically delivered from the paper cassette 3 by a paper-supply roller 15 or a manually supplied sheet P' from the sheet-bypass guide 6 into the receiving tray 4 through an image transfer region 16 which is defined between the photosensitive member 7 and the transfer unit 11. A pair of aligning rollers 18 are arranged in the middle of the paper conveying path 17 on the upper-course side of the image transfer region 16 with respect to the paper conveying direction, and a fixing unit 19 and a pair of exit rollers 20 on the lower-course side.

The exposure unit 9 includes an exposure lamp 22 backed by a reflector 21 and a focusing light transmitter (trademark: Selfoc Lens Array) 23 for leading a reflected light from an original paper irradiated by the exposure lamp 22. The exposure lamp 22 is designed so that its luminous energy is automatically changed as required in order to prevent the copy density from varying with the color tone of developing agent when a first or second developing unit (mentioned later) is selected. The photosensitive member 7 is driven in synchronism with the original table 2 in the direction of arrow b by a drive mechanism (described in detail later) with the aid of an electromagnetic clutch (not shown). When the photosensitive member 7 is driven at a high or low speed selected by the electromagnetic clutch, the original table 2, aligning rollers 18, and exit rollers 20, which are also driven by the drive mechanism for the photosensitive member 7, move or rotate at a high or low speed in synchronism with the photosensitive member 7.

The photosensitive member 7 is uniformly charged by the main charger 8, and the reflected light from the original uniformly irradiated by the exposure lamp 22 is projected on the photosensitive member 7 by the focusing light transmitter 23. As a result, an electrostatic latent image responsive to an image of the original is formed on the photosensitive member 7. The electrostatic latent image formed in this manner is developed into a toner image by the developing device 10, and delivered to the transfer region 16.

Meanwhile, the automatically or manually supplied sheet P or P' is fed deep into the copying machine housing 1 by the aligning rollers 18, and the toner image previously formed on the photosensitive member 7 is transferred to the surface of the sheet P or P' by the transfer unit 11 in the transfer region 16. Then, the sheet P or P' is separated from the photosensitive member 7 by the separation unit 12 using AC corona discharge, and fed along the conveying path 17 to the fixing unit 19. The fixing unit 19 melts and fixes the toner image on the sheet P or P', which is discharged into the receiving tray 4 by the exit rollers 20.

Residual toner remaining on the photosensitive member 7 after the transfer of the toner image to the sheet P (P') is cleared out by the cleaning unit 13, and the potential on the photosensitive member 7 is lowered below a predetermined level by the afterimage erasing unit 14 to be ready for copying operation.

Numeral 25 designates a fan as a cooling unit. The fan 25 discharges heat produced by the heat generating parts in the copying machine housing 1, including the exposure lamp 22 and the fixing unit 19. In order to remove heat from a power supply unit 26, moreover, a main motor 27 constituting the drive mechanism for the photosensitive member 7 is furnished with an exhaust unit 28.

Inside the copying machine housing 1, upper and lower frames are swingably pivoted at one end portion on a supporting shaft 29. With this arrangement, the other end portions of the two frames can be swung apart through a desired angle, e.g., 30 degrees. The upper frame is fitted by suitable means with the photosensitive member 7 and the other units surrounding the same, including the main charger 8, the focusing light transmitter 23, the exposure lamp 22, the developing device 10, the cleaning unit 13, and the afterimage erasing unit 14. Also, the fan 25 as the cooling unit, the paper-supply roller 15, and the original table 2 are mounted on the upper frame. Thus, the upper frame and those units thereon constitute an upper unit 1A. On the other hand, the lower frame is fitted by suitable means with the paper cassette 13, the transfer unit 11, the separation unit 12, a guide plate 30 forming the conveying path 17, the fixing unit 19, the exit rollers 20, the receiving tray 4, the main motor 27, and the power supply unit 26, thus constituting a lower unit 1B. According to this arrangement, after a front cover (not shown) of the copying machine housing 1 is swung and removed, the housing 1 can be divided into the upper and lower unit 1A and 1B substantially along the sheet conveying path 17 by releasing a housing lock device so that the conveying path 17 is exposed. Thus, if the sheet P (P') is jammed on the conveying path 17, it can be removed with ease.

The pair of aligning rollers 18 serve to correct a skew of the leading edge of the sheet P automatically delivered from the paper cassette 3 or the manually supplied sheet P', and to feed the sheet P or P' toward the transfer region 16 in synchronism with the formation of the toner image on the photosensitive member 7. A manual supply detection switch 31 is disposed just before the aligning rollers 18.

In FIG. 1, numeral 32 designates an exit switch, 33 a total counter, and 34 a paper-empty switch for detecting the absence of the paper sheets P in the paper cassette 2.

Numeral 35 designates a high-voltage transformer, which delivers a bias voltage for charging, transferring, de-electrification, and developing. In order to apply proper amounts of electric charges to the photosensitive member 7 and other members in accordance with the rotating speed of the photosensitive member 7, the output voltage of the high-voltage transformer 35 is automatically selected between high and low voltages depending on the rotating speed of the photosensitive member 7. Numeral 36 designates a de-electrification brush, 37 a grip formed at the exhaust port portion of the fan 25, and 38 an auxiliary reflector.

A blade solenoid 39 is provided to cause a cleaning blade 40 of the cleaning unit 13 to touch and leave the photosensitive member 7.

Figure 2:
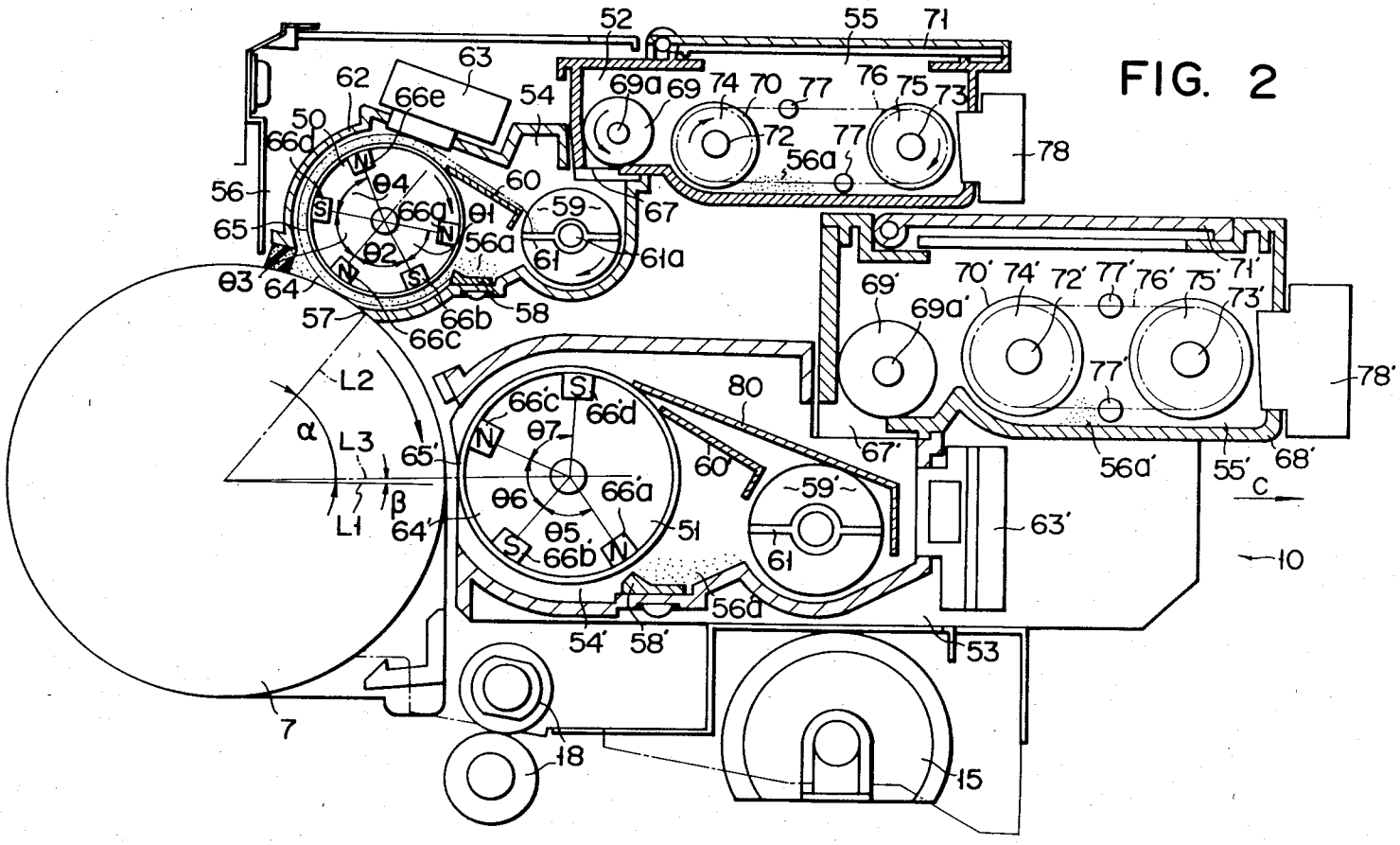

As shown in detail in FIG. 2, the developing device 10 includes a first developing roller 50 as a first developing member carrying thereon a first developing agent **56*a'*, e.g., a black developing agent, and a second developing roller 51 as a second developing member carrying thereon a second developing agent 56*a*, e.g., a red, yellow or blue developing agent. Thus, by selectively driving the developing rollers 50 and 51**, a color copy may be produced whose color is a combination of black and another color, e.g., red, yellow or blue.

In other words, the developing device 10 is divided into two parts; a first developing unit 52 as first developing means including the first developing roller 50 and a second developing unit 53 as second developing means including the second developing roller 52. The first developing unit 52 on the upper side is fixedly mounted on the copying machine housing 2, while the second developing unit 52 on the lower side can be pulled to the right of FIG. 2 (as indicated by arrow C) to be drawn out of the housing 1. The black first developing agent **56*a'*, which is expected to be needed more frequently, is used in the second developing unit 53 which is easier to maintain, and the second developing agent 56*a*, which should be needed less frequently, is used in the first developing unit 52**.

Since the second developing unit 53 is used more frequently, the diameter of the second developing roller 51 is greater than that of the first developing roller 50, thus improving conditions for developing in high-speed copying operation.

The first developing unit 52 consists of a first developing mechanism section 54 and a first developing agent supply section 55. The first developing mechanism section 54 includes the first developing roller 50, a first doctor 58 disposed on the upper-course side (with respect to the direction of feed of the second developing agent) of a first developing region 57 or the position at which the photosensitive member 7 is in sliding contact with a magnetic brush 56 of the second developing agent 56*a* formed on the surface of the first developing roller, whereby the thickness of the magnetic brush 56 is regulated, a first scraper 60 disposed on the lower-course side of the first developing region 57 and adapted to scrape off the magnetic brush 56 on the surface of the first developing roller 50 and to feed it into a developing agent storage portion 59, a developing agent stirrer 61 in the developing agent storage portion 59, and a first casing 62 containing all these members. A first toner density detector 63 is attached to that portion of the first casing 62 corresponding to the upper portion of the first developing roller 50. The first toner density detector 63 detects the density of the second developing agent 56*a* by magnetically sensing a change of the permeability of the second developing agent 56*a*.

The first developing roller 50 is formed of a first magnet roll 64 whose center lies on a straight line L2 which passes through the center of rotation of the photosensitive member 7 and is inclined at an angle $\alpha$ ($\alpha=51°25'$) to a horizontal line L1, and a first sleeve 65 fitted on the outer peripheral surface of the first magnet roll 54 and rotating in the clockwise direction of FIG. 2.

The first magnet roll 64 includes first to fifth polar blocks 66*a*, 66*b*, 66*c*, 66*d* and 66*e*. The first, third and fifth polar blocks 66*a*, 66*c* and 66*e* are north poles, while the second and fourth polar blocks 66*b* and 66*d* are south poles. The angle $\theta_1$ between the first and second polar blocks 66*a* and 66*b* is $\theta_1=50°$: angle $\theta_2$ between 66*b* and 66*c*, $\theta_4=68°$, angle $\theta_3$ between 66*c* and 66*d*, $\theta_3=60°$. and angle $\theta_4$ between 66*d* and 66*e*, $\theta_4=60°$.

The first developing agent supply section 55 includes a first hopper 68 with a first developing agent supply port 67 facing the first developing agent storage portion 59 of the first developing mechanism section 54, a first developing agent supply roller 69 disposed in the first hopper 68 so as to close the first developing agent supply port 67, and a first stirring mechanism 70 for stirring the second developing agent 56*a* in the first hopper 68 so that the second developing agent 56*a* is fed to the first developing agent supply roller 69. The top opening of the first hopper 68 is closed by a first cover 71 which is pivoted at one end. The first hopper 68 can readily be supplied with the second developing agent 56*a* after removing the original table 2 and the first cover 71.

The first stirring mechanism 70 includes a first driving shaft 72, a first driven shaft 73 parallel thereto, two pairs of sprockets 74 and 75, each pair at either end portion of each corresponding shaft 72 or 73, two endless chains 76 stretched between the sprockets 74 and 75 and adapted to simultaneously travel in the same direction, and stirring members 77 formed of coil springs coupled at both ends to the two endless chains 76.

A first toner-empty detector 78 for detecting a shortage of the second developing agent 56*a* in the first hopper 68 is attached to the right-hand side face of the first hopper 68.

The second developing unit 53 has substantially the same construction as the first developing unit 52 described above. The former, however, differs from the latter in the arrangement of poles of a second magnet roll 64' of the second developing roller 51, the mounting position of a second toner density detector 63', and the addition of a narrow second scraper 80 (e.g., 50 mm thick) to cope with the shift of the detector 63'. In the description to follow, like reference numerals, but with a prime each, are used to designate like members as included in the first developing unit 52, and a detailed description of these members is omitted.

The second magnet roll 64' of the second developing roller 51 includes first to fourth polar blocks 66*a'*, 66*b'*, 66*c'* and 66*d'*. The first and third polar blocks 66*a'* and 66*c'* are north poles, while the second and fourth polar blocks 66*b'* and 66*d'* are south poles. The angle $\theta_5$ between the first and second polar blocks 66*a'* and 66*b'* is $\theta_6=73°$; angle $\theta_6$ between 66*b'* and 66*c'*, $\theta_7=75°$, and angle $\theta_7$ between 66*c'* and 66*d'*, $\theta_7=70°$. The center of the second magnet roll 64' lies on a straight line L3 which passes through the center of rotation of the photosensitive member 7 and is inclined at an angle $\beta$ ($\beta=1°54'$) to the horizontal line L1.

The first and second magnet rolls 64 and 64' of the first and second developing units 52 and 53 are allowed to rock through 25 degrees each from predetermined positions shown in FIG. 2. As the first and second magnet rolls 64 and 64' rock within this range, first and second magnetic brushes 56 and 56' of the second and first developing agents 56*a* and 56*a'* can be formed or removed on the surfaces of the first and second developing rollers 50 and 51.

When the first and second magnet rolls 64 and 64' of the first and second developing units 52 and 53 are shifted to the predetermined positions by a roll/rocking mechanism (not shown), the magnetic brush 56 or 56' is formed on the surface of only one of the first and second developing rollers 50 and 51 of the first and second developing units 52 and 53.

In operating the first developing unit 52, the first magnet roll 64 of the first developing unit 52 is set in a position such that the third pole 66*c* faces the first developing region 57 and that the first doctor 58 is located substantially halfway between the first and second poles 66*a* and 66*b*, while the second magnet roll 64' of the second developing unit 53 is set so that the first pole 66*a'* faces a second doctor 58', as shown in FIG. 2. Thus, the first magnetic brush 56 of the second developing agent 56*a* is formed only on the surface of the first developing roller 50 of the first developing unit 52.

Figure 3:
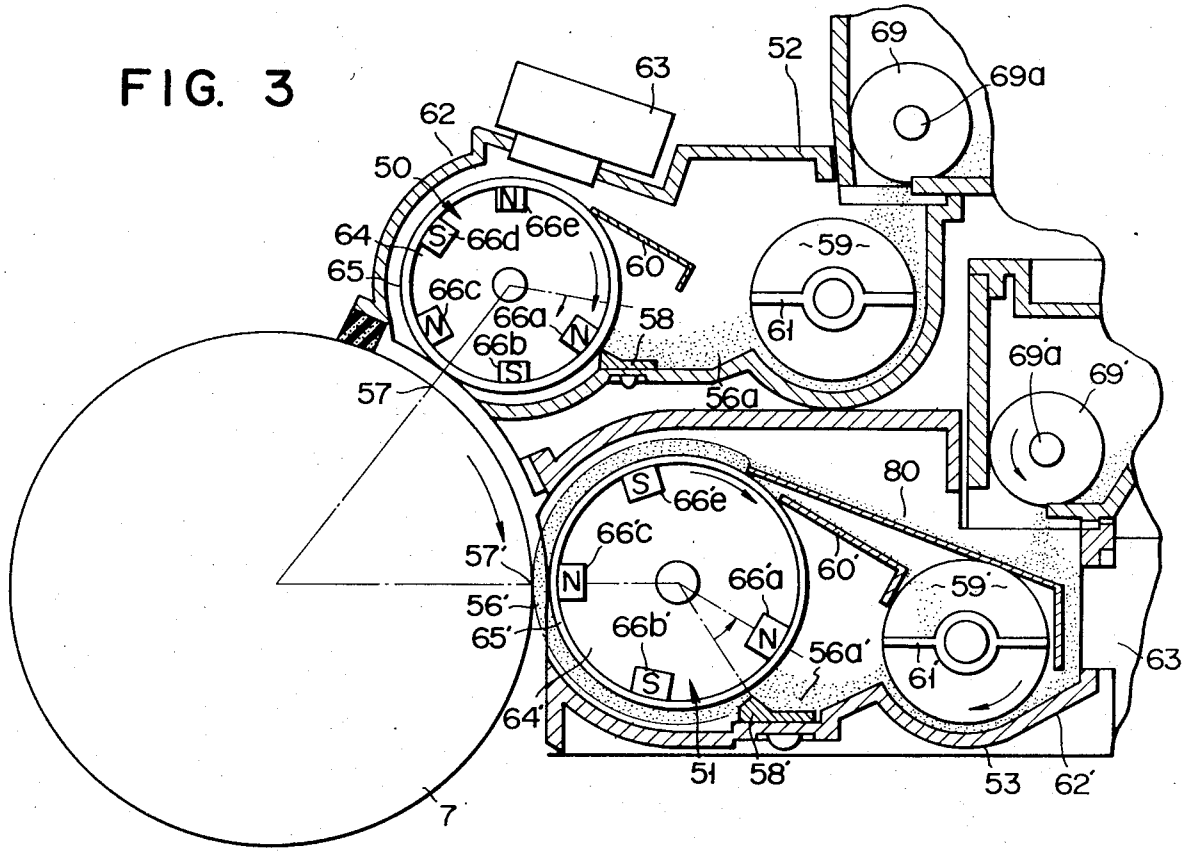

In operating the second developing unit 53, on the other hand, the first magnet roll 64 of the first developing unit 52 is rocked clockwise through 25 degrees from the position of FIG. 2 so that the first pole 66*a* faces the first doctor 58, and the second magnet roll 64' of the second developing unit 53 is rocked counterclockwise through 25 degrees from the position of FIG. 2 so that the second doctor 58' is located substantially halfway between the first and second poles 66*a'* and 66*b'*, as shown in FIG. 3. Thus, the second magnetic brush 56' of the first developing agent 56*a'* is formed only on the surface of the second developing roller 51 of the second developing unit 53.

When the first pole 66*a* (66*a'*) of the magnet roll 64 (64') is opposed to the doctor 58 (58') which is formed from a nonmagnetic material, the magnetic brush 56 (56') ceases to be formed on the surface of the developing roller 50 (51) for the following reasons. Around the first pole 66*a* (66*a'*), the magnetic brush produced by the first pole 66*a* (66*a'*) is so sparse that it cannot positively attract the developing agent 56*a* (56*a'*). Therefore, the magnetic brush 56 (56') can easily be controlled by the doctor 58 (58'). Thus, the developing agent 56a (56a') will never pass by the doctor 58 (58') even though the sleeve 65 (65') rotates.

The driving forces of the driving parts of the first developing unit 52, including the sleeve 65 of the developing roller 52, the developing agent stirrer 61, the developing agent supply roller 69, and the driving shaft 72 of the stirring mechanism 70, and transmitted by means of a first driving force transmission system 85, which will be described in detail later. The driving forces of driving parts of the second developing unit 53, including a sleeve 65' of the developing roller 51, a developing agent stirrer 61', a developing agent supply roller 69', and a driving shaft 72' of a stirring mechanism 70', are transmitted by means of a second driving force transmission system 86, which will be described in detail later.

Figure 4:
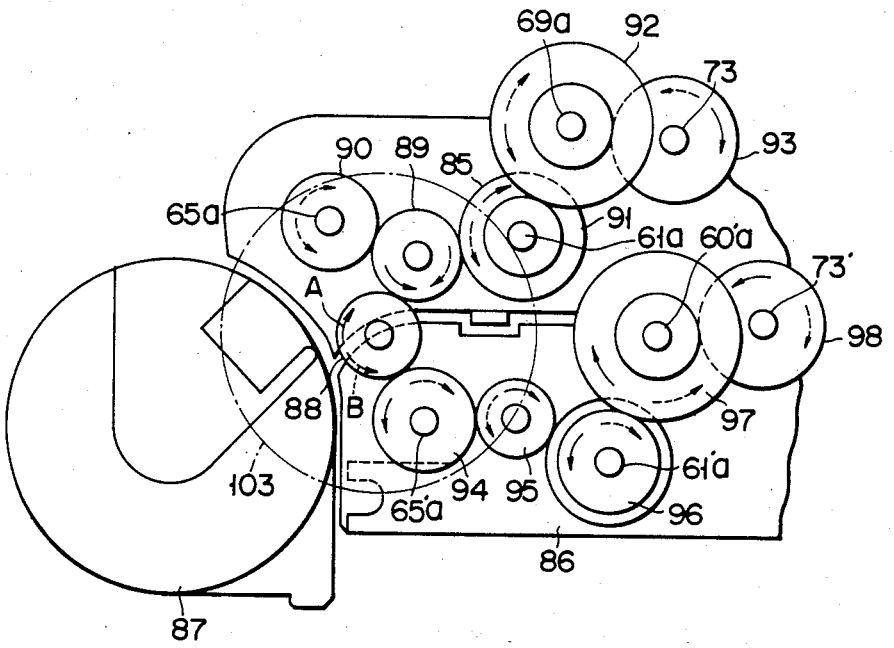
Figure 5:
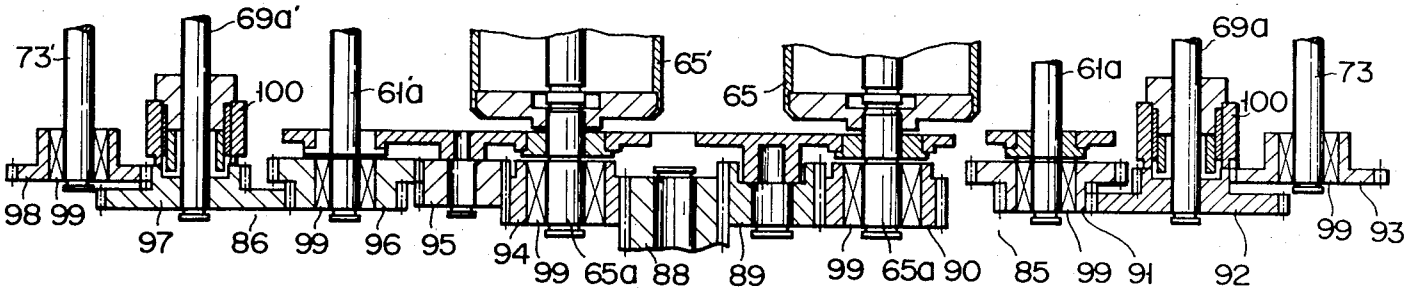
Figure 6:
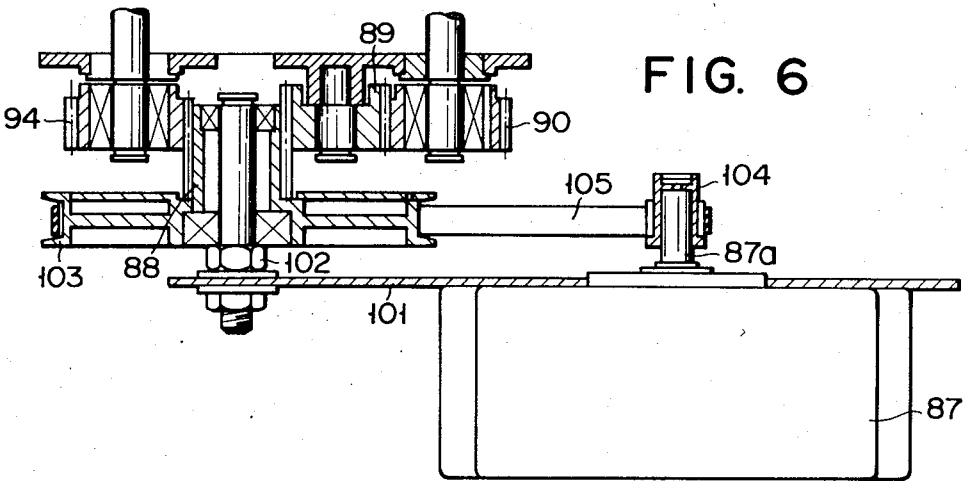

The first and second driving force transmission systems 85 and 86 are constructed as shown in FIGS. 4 to 6. As a reversible motor 87 as a common drive source is rotated forwardly or reversely, only the driving parts of either the first or the second developing unit 52 or 53 are operated selectively. Thus, the mechanisms are simplified, and the number of components required is reduced. Moreover, the developing device 10 is protected against early-stage deterioration attributed to unnecessary stirring and conveyance of the developing agent 56a (56a').

The respective rotating speeds of the first and second developing rollers 50 and 51 are adjusted for proper developing conditions, and are not necessarily equal.

The main motor 27 (FIG. 1), which serves as a drive mechanism for rotating the photosensitive member 7 in the direction indicated by arrow b, is formed of a pulse motor. The main motor 27 and the photosensitive member 7 are coupled by means of a suitable driving force transmission mechanism, e.g., a belt-pulley mechanism or gear mechanism, so that the photosensitive member 7 rotates as the main motor 27 rotates. Since the main motor 27 is a pulse motor, its rotating speed depends on the number of pulses applied per unit time to the main motor 27.

The power supply unit 26 is provided with a pulse generator circuit 26a (shown only in brief in FIG. 1), which is connected to the color designating button means on the control panel. If use of the black first developing agent for development is designated by the color designating button means, and when the second developing unit 53 is started, the pulse generator circuit 26a produces pulses which cause the photosensitive member 7 to rotate at a peripheral speed of 250 mm/sec. On the other hand, if use of the second developing agent (e.g., red developing agent) for developing is designated by the color designating button means, and when the first developing unit 52 is started, the pulse generator circuit 26a produces pulses which cause the photosensitive member 7 to rotate at a peripheral speed of 175 mm/sec. If the photosensitive member 7 rotates at the peripheral speed of 250 mm/sec, then 40 copies will continuously be made in one minute. If the photosensitive member 7 rotates at 175 mm/sec, then 28 copies will be made per minute.

Referring now to FIGS. 4 to 6, the driving force transmission systems 85 and 86 will be described. FIG. 4 is a schematic front view showing the first and second driving force transmission system 85 and 86, and FIG. 5 is a sectional view showing the first and second driving force transmission systems 85 and 86 developed around a driving gear 88.

The first driving force transmission system 85 includes an intermediate gear 89 in mesh with the driving gear 88 which is driven directly by the reversible motor 87, first and second driven gears 90 and 91 in mesh with the intermediate gear 89, a third driven gear 92 in mesh with the second driven gear 91, and a fourth driven gear 93 in mesh with the third driven gear 92.

The second driving force transmission system 86 includes a fifth driven gear 94 in mesh with the driving gear 88, an intermediate gear 95 in mesh with the fifth driven gear 94, a sixth driven gear 96 in mesh with the intermediate gear 95, a seventh driven gear 97 in mesh with the sixth driven gear 96, and an eighth driven gear 98 in mesh with the seventh driven gear 97.

When the driving gear 88 rotates forwardly or in the clockwise direction indicated by full-line arrow A in FIG. 4, the individual gears 89, 90, 91, 92 and 93 of the first driving force transmission system 85 and the gears 94, 95, 96, 97 and 98 of the second driving force transmission system 86 rotate in the directions indicated by the individual full-line arrows. On the other hand, when the driving gear 88 rotates reversely or in the counterclockwise direction indicated by broken-line arrow B, the gears 89 to 93 of the first driving force transmission system 85 and the gears 94 to 98 of the second driving force transmission system 86 rotate in the directions indicated by the individual broken-line arrows.

The first, second and fourth driven gears 90, 91 and 93 are mounted on a driving shaft 65a integral with the sleeve 65, a driving shaft 61a of the developing agent stirrer 61, and the first driving shaft 72 of the first stirring mechanism 70, respectively, by means of their corresponding one-way clutches 99 which transmit clockwise rotations only. Thus, the driving force is transmitted to the driving shafts 65a, 61a and 72 only when the gears 90, 91 and 93 rotate in the direction indicated by the full-line arrows, that is, when the driving gear 88 rotates forwardly. The third driven gear 92 is linked with a driving shaft 69a of the developing agent supply roller 69 by means of a spring clutch 100. Thus, the developing agent supply roller 69 can be rotated as required in the direction for developing agent supply by throwing in the spring clutch 100 while the third gear 92 is rotating in the direction indicated by the full-line arrow.

The fifth, sixth and eighth driven gears 94, 96 and 98 are mounted on a driving shaft 65a' integral with the sleeve 65' of the second developing roller 51, a driving shaft 61a' of the developing agent stirrer 61', and the driving shaft 72' of the stirring mechanism 70', respectively, by means of their corresponding one-way clutches 99 which transmit clockwise rotations only. Thus, the driving force is transmitted to the driving shafts 65a', 61a' and 72' only when the gears 94, 96 and 98 rotate in the direction indicated by the broken-line arrows, that is, when the driving gear 88 rotates reversely. The seventh driven gear 97 is linked with a driving shaft 69a' of the developing agent supply roller 69' by means of another spring clutch 100. Thus, the developing agent supply roller 69' can be rotated as required in the direction for developing agent supply by throwing in the second spring clutch 100 while the seventh gear 97 is rotating in the direction indicated by the broken-line arrow.

As shown in FIG. 6, the driving gear 88 is rotatably mounted by means of a bearing on a shaft 102 which is attached to a frame 101. The driving gear 88 is provided integrally with a pulley 103. The pulley 103 is linked by means of a timing belt 105 with a driving pulley 104 which is mounted on a driving shaft 87*a* of the reversible motor 87 as the drive source. Thus, the first and second developing units 52 and 53 can selectively be operated by only switching the rotating direction of the reversible motor 87. Namely, the first developing unit 52 is actuated only when the reversible motor 87 is rotated forwardly, and the second developing unit 53 is actuated only when the motor 87 is rotated reversely.

The change of the rotating direction of the reversible motor 87 is accomplished by depressing the color designating button means on the control panel (not shown). At the same time, the magnet roll 64 or 64' which is not engaged in operation is shifted by the roll/rocking mechanism (not shown) so that its first pole 66*a* or 66*a'* faces its corresponding doctor 58 or 58'. Thus, if the use of the black first developing agent for developing is designated by the color designating button means, the reversible motor 87 is reversely rotated to drive the second developing unit 53 only. If the red second developing agent is designated, the reversible motor 87 is forwardly rotated to drive the first developing unit 52 only.

The developing operation of the developing device 10 will now be described in detail. First, when the black first developing agent is designated by the color designating button means to actuate the second developing unit 53, the photosensitive member 7 is rotated at the peripheral speed of 250 mm/sec, and the magnet rolls 64 and 64' are situated as shown in FIG. 3. Meanwhile, the reversible motor 87 is rotated reversely, so that only the second sleeve 65' of the second developing roller 51 is rotated clockwise from the position shown in FIG. 3. Thus, the magnetic brush 56' of the first developing agent is formed on the surface of the second sleeve 65'.

Then, those portions of the electrostatic latent image on the photosensitive member 7 which represent black regions of the original image are developed by means of the black first developing agent 56*a'*.

When the development of the electrostatic latent image for the black regions of the original image is accomplished in this manner, the second magnet roll 64' is rocked through 25 degress so that the first pole 66*a'* faces the second doctor 58'. Thus, the magnetic brush 56' ceases to be formed afresh on the second sleeve 65'. In this state, the second sleeve 65' is further rotated through a predetermined angle so that the magnetic brush 56' of the first developing agent is removed from the surface of the second sleeve 65'. At this time, the magnetic brush 56 of the red second developing agent is not formed on the first developing roller 50. Thus, there will be no possibility of color mixing without regard to the selection between the developing units 52 and 53 for the next cycle of developing operation.

If the first developing unit 52 is designated for color developing by operating the color designating button means, the photosensitive member 7 is rotated at the peripheral speed of 175 mm/sec by the main motor 27, and the magnet rolls 64 and 64' are situated as shown in FIG. 2. Meanwhile, the reversible motor 87 is rotated forwardly, so that the first sleeve 65 of the first developing roller 50 is rotated clockwise from the position of FIG. 2. Thus, the magnetic brush 56 of the red second developing agent is formed on the surface of the first sleeve 65. Then, those portions of the electrostatic latent image on the photosensitive member 7 which represent red regions of the original image are developed by means of the red second developing agent in the same manner as aforesaid. Thereafter, the magnetic brush 56 of the second developing agent is removed from the surface of the first sleeve 65, and the developing operation is completed.

Meanwhile, the developing agent stirrer 61 (61') and the stirring mechanism 70 (70') of that developing unit 52 (53) engaged in the developing operation are continually operating, and the developing agent supply roller 69 (69') is supplied as required with the developing agent 56*a* (56*a'*) in response to a signal from the toner density detector 63 (63'). Thus, a satisfactory developing operation can be maintained.

Since the poles of the magnet rolls 64 and 64' of the first and second developing rollers 50 and 51 are arranged in the aforementioned manner, the magnetic brushes 56 and 56' are protected against defective formation without providing any magnetic shield means between the two magnet rolls 64 and 64'.

In the present embodiment, the black first developing agent in greater demand is stored in the second hopper 68' which is larger in capacity than the first hopper 68. Accordingly, the number of copies producible for each cycle of developing agent supply is increased, resulting in improved operating efficiency. Further, the second developing roller 51, which should be used more frequently, is made greater in diameter, so that the quality of copy images obtained with use of the black developing agent is greatly improved. In general, those regions of an image developed with use of the second developing agent of a color other than black are narrower in area than those regions obtained with use of the black developing agent. Accordingly, there will be no substantial problems even through the image portions developed by the second developing agent are lower in quality than those portions developed by the first developing agent.

It is to be understood that the present invention is not limited to the arrangement of the embodiment described above, and that various changes and modifications may be effected therein by one skilled in the art without departing from the scope or spirit of the invention.

Figure 7:
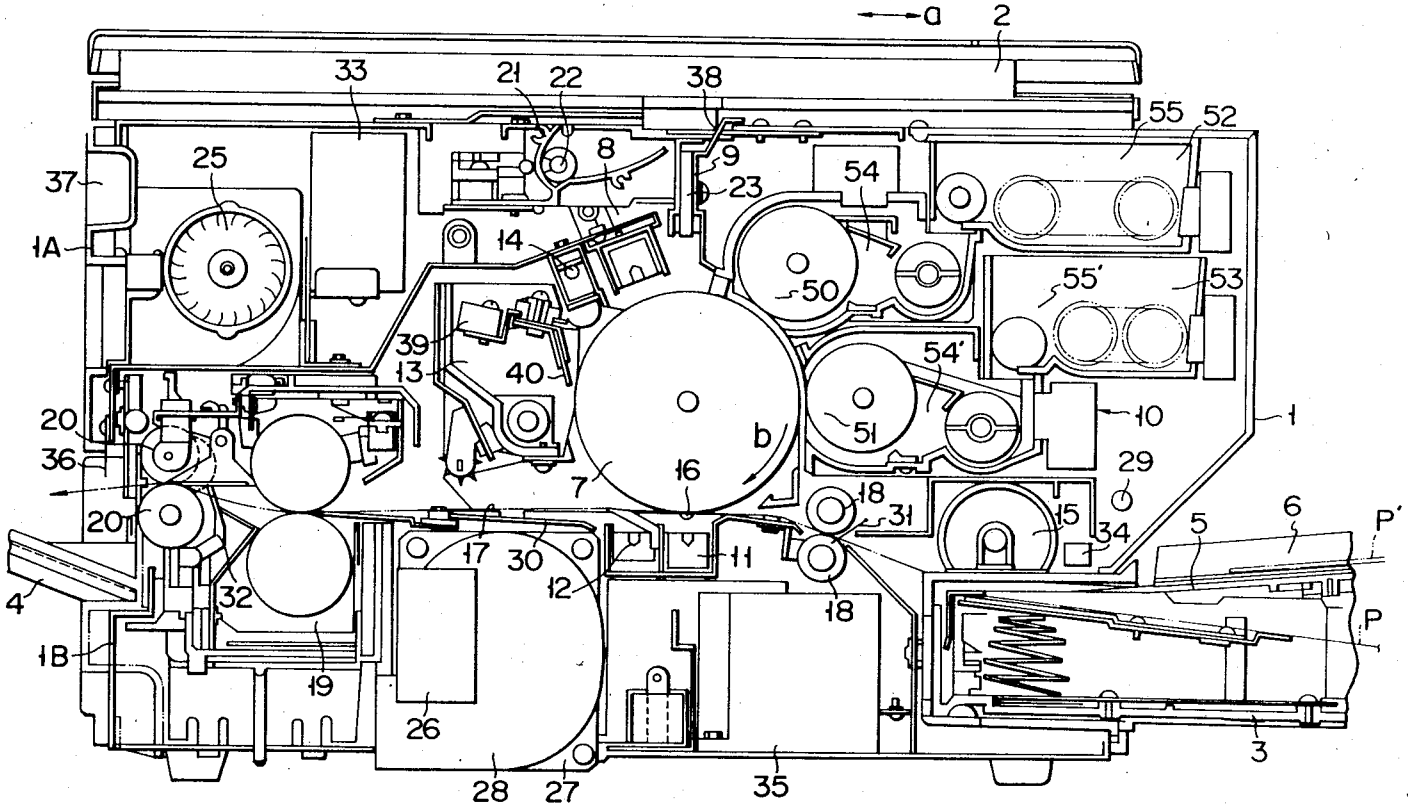
FIG. 7 is a front view showing another embodiment of the image forming apparatus of the invention applied to a copying machine.

In the embodiment described above, for example, the first and second developing rollers 50 and 51 have been described as being different in diameter. Alternatively, however, the two developing rollers 50 and 51 may have the same diameter, as in another embodiment shown in FIG. 7.

In the first embodiment, moreover, the first and second developing agents have been described as being different in color. Alternatively, however, the two developing agents may have the same color, e.g., black color, but be different in mean particle diameter. In this case, the relative rotating speeds of the first and second developing rollers 50 compared with the photosensitive member 7 should be different. If the mean particle diameter of a developing agent is changed, then the quality of images obtained will also be changed. If an image to be developed needs to be expressly characterized by its halftone, the developing agent used will be required to have a small mean particle diameter. A developing agent with a relatively large mean particle diameter may be used for the development of such images as characters or graphic charts. If the mean particle diameter of the developing agent varies, then the charging level will change, so that the amount of developing agent sticking to the electrostatic latent image will also change. Therefore, it is necessary to change the amount of developing agent supplied per unit time to the electrostatic latent image according to the mean particle diameter of the developing agent, thereby keeping the image density at a fixed optimum level. In order to change the amount of developing agent supply per unit time to the electrostatic latent image, it is necessary to change the relation between the peripheral speeds of the developing roller 50 (51) and the photosensitive member 7.

The relative speeds of the two developing rollers compared with the photosensitive member may be changed as follows. First, the peripheral speed of the photosensitive member may be changed without varying those of the two developing rollers. Alternatively, the peripheral speeds of the two developing rollers may be changed while maintaining that of the photosensitive member, or the respective peripheral speeds of the photosensitive member and the two developing rollers may be changed independently. The peripheral speeds of the two developing rollers can easily be made different from each other by using different transmission gear ratios for the two driving force transmission systems 85 and 86.

According to the present invention, as described above, there may be provided an image forming apparatus of small size and light weight, which, despite its simple construction, can perform a developing operation in conditions best suited for a plurality of developing units, without requiring an undue increase in size of rotating members carrying developing agents thereon in a developing device.

What is claimed is:

1. An image forming apparatus comprising:

an image carrier movable in one direction and carrying thereon a latent image responsive to an original image;

first developing means rotatably disposed opposite the surface of the image carrier, carrying a first developing agent thereon, and adapted to supply the first developing agent to the image carrier while rotating, thereby developing the latent image by means of the first developing agent;

second developing means rotatably disposed opposite the surface of the image carrier and adjacent to the first developing means, carrying a second developing agent thereon, and adapted to supply the second developing agent to the image carrier while rotating, thereby developing the latent image by means of the second developing agent; and drive means for moving the image carrier in said one direction and selectively rotating the first and second developing means, said drive means being adapted to move the image carrier relatively to the first developing means at a first relative speed when the first developing means is rotated and to move the image carrier relatively to the second developing means at a second relative speed different from the first relative speed when the second developing means is rotated.

2. The image forming apparatus according to claim 1, wherein said image carrier includes a rotatable, drum-shaped photosensitive member, and said drive means includes a first motor for rotating the photosensitive member.

3. The image forming apparatus according to claim 2, wherein said first motor is adapted to rotate the photosensitive member at a first peripheral speed when the first developing means is rotated and to rotate the photosensitive member at a second peripheral speed different from the first pheripheral speed when the second developing means is rotated, so that a first relative speed of the first developing means compared with the photosensitive member is different from a second relative speed of the second developing means compared with the photosensitive member.

4. The image forming apparatus according to claim 3, wherein said first motor is formed of a pulse motor with a variable rotating speed.

5. The image forming apparatus according to claim 2, wherein said drive means includes a second motor for selectively rotating the first and second developing means.

6. The image forming apparatus according to claim 5, wherein said second motor is a reversible motor, and said drive means includes first transmission means adapted to transmit a forward rotation of the second motor to the first developing means but not to the second developing means and second transmission means adapted to transmit a reverse rotation of the second motor to the second developing means but not to the first developing means, whereby the first and second developing means are selectively rotated as the second motor is rotated forwardly or reversely.

7. The image forming apparatus according to claim 6, wherein said first developing means includes a first developing roller having a predetermined diameter, and said second developing means includes a second developing roller having a diameter equal to the predetermined diameter.

8. The image forming apparatus according to claim 7, wherein said first transmission means transmits the rotating speed of the second motor to the first developing roller at a first transmission ratio, and said second transmission means transmits the rotating speed of the second motor to the second developing roller at a second transmission ratio, so that the first relative speed of the first developing roller compared with the photosensitive member is different from the second relative speed of the second developing roller compared with the photosensitive member while the second motor is rotated forwardly or reversely.

9. The image forming apparatus according to claim 6, wherein said first developing means includes a first developing roller having a first diameter, and said second developing means includes a second developing roller having a second diameter different from the first diameter.

10. The image forming apparatus according to claim 9, wherein said first and second transmission means transmit the rotating speed of the second motor to the first and second developing rollers, respectively, at the same transmission ratio, so that the first relative speed of the first developing roller compared with the photosensitive member is different from the second relative speed of the second developing roller compared with the photosensitive member while the second motor is rotated forwardly or reversely.

11. The image forming apparatus according to claim 10, wherein said first motor is adapted to rotate the photosensitive member at a first peripheral speed when the first developing means is rotated and to rotate the photosensitive member at a second peripheral speed different from the first peripheral speed when the second developing means is rotated.

12. The image forming apparatus according to claim 1, wherein said first developing agent has a first color, and said second developing agent has a second color different from the first color.

13. The image forming apparatus according to claim 12, wherein said first color is black, and said second color is a color other than black.

14. The image forming apparatus according to claim 1, wherein said first and second developing agents have the same color, the first developing agent having a first mean particle diameter and the second developing agent having a second mean particle diameter different from the first mean particle diameter.

* * * * *